US009623420B2

(12) United States Patent
Dobrovosky et al.

(10) Patent No.: US 9,623,420 B2
(45) Date of Patent: Apr. 18, 2017

(54) ADJUSTABLE FLOW REGULATING ELEMENT RETENTION MECHANISM FOR MATERIAL PROCESSING APPARATUS

(71) Applicants: Henry Scott Dobrovosky, Skaneateles, NY (US); Michael J. Vitale, Jr., Auburn, NY (US); Blue Sky Milling LLC, Auburn, NY (US)

(72) Inventors: Henry Scott Dobrovosky, Skaneateles, NY (US); Richard James O'Neal, Bay Minette, AL (US); Bret Xavier Faircloth, Mobile, AL (US)

( * ) Notice: Subject to any disclaimer, the term of this patent is extended or adjusted under 35 U.S.C. 154(b) by 344 days.

(21) Appl. No.: 14/103,923

(22) Filed: Dec. 12, 2013

(65) Prior Publication Data

US 2015/0165442 A1 Jun. 18, 2015

(51) Int. Cl.
*B02C 13/28* (2006.01)
*B02C 13/06* (2006.01)
*B02C 13/20* (2006.01)

(52) U.S. Cl.
CPC ..... *B02C 13/2804* (2013.01); *B02C 13/06* (2013.01); *B02C 13/20* (2013.01)

(58) Field of Classification Search
CPC ..... B02C 18/18; B02C 18/182; B02C 18/145; B02C 18/184; B02C 18/186; B02C 18/146; B02C 18/06; B02C 18/144; B02C 18/28; B02C 13/2804; B02C 13/06; B02C 13/20; B23C 2265/12; B23C 2265/36
USPC ..... 407/41, 49, 108; 74/20; 241/294, 295, 241/189.1, 289, 290
See application file for complete search history.

(56) References Cited

U.S. PATENT DOCUMENTS 2,149,571 A 3/1939 Battey
3,622,086 A 11/1971 Yamagishi
3,865,164 A * 2/1975 Sybertz ..... 144/230
4,193,719 A * 3/1980 Oaks ..... B23C 5/207 407/41

(Continued)

FOREIGN PATENT DOCUMENTS

DE 20303909 * 3/2003 ..... B21J 13/03

OTHER PUBLICATIONS

Translation of Foreing Document DE20303909 Is Attached as DE20303909.PDF.*

*Primary Examiner* — Faye Francis
*Assistant Examiner* — Onekki Jolly
(74) *Attorney, Agent, or Firm* — Barclay Damon, LLP

(57) ABSTRACT

A material collider apparatus includes at least one rotor disposed for rotational movement having a plurality of circumferentially disposed pockets, each of the pockets retaining a portion of a flow velocity regulator and an adjustable retention mechanism. The adjustable retention mechanism includes a first wedge portion and a second wedge portion, the wedge portion each having inclined surfaces that are engaged with one another. An actuating member is disposed through the first and second wedge portions, in which the second wedge portion includes a mounting surface in contact with an edge of the velocity regulator and the first wedge portion includes a mounting surface in contact with an edge surface of the pocket. The second wedge portion is movable relative to said first wedge portion when the actuating member is engaged, thereby permitting tightening and release of the velocity regulator in a defined rotor pocket.

17 Claims, 8 Drawing Sheets

(56) References Cited

U.S. PATENT DOCUMENTS 5,320,292 A 6/1994 Smith
5,400,977 A 3/1995 Hayles, Jr.
5,474,244 A 12/1995 Gotz
5,529,249 A * 6/1996 Braun ..... B02C 13/06 241/189.1
5,647,419 A * 7/1997 Stewart ..... B27G 13/10 144/117.1
5,829,692 A 11/1998 Walters
5,887,809 A 3/1999 Walters
5,941,467 A 8/1999 McArdle et al.
5,947,396 A 9/1999 Pierce
5,954,281 A 9/1999 Hayles, Jr.
5,967,436 A 10/1999 Balvanz
6,079,649 A * 6/2000 Balvanz ..... B02C 13/09 241/189.1
6,202,949 B1 3/2001 Hayles, Jr.
6,230,996 B1 5/2001 Angers, Jr.
6,293,481 B1 * 9/2001 Ragnarsson ..... B02C 18/146 241/197
6,311,910 B1 11/2001 Balvanz et al.
6,419,173 B2 7/2002 Balvanz et al.
6,464,157 B1 10/2002 Balvanz et al.
6,481,655 B1 11/2002 Feigel, Jr.
6,669,125 B1 12/2003 Howard
7,055,769 B2 6/2006 Pierce
7,059,552 B2 6/2006 Hayles, Jr.
7,204,442 B2 * 4/2007 Roozeboom et al. ..... 241/191
7,229,037 B1 6/2007 Hayles, Jr.
7,448,567 B2 11/2008 Roozeboom et al.
7,900,861 B2 * 3/2011 Sharp ..... B02C 18/18 241/294
7,950,601 B2 5/2011 Watts
8,033,490 B1 10/2011 Young
2001/0045478 A1 * 11/2001 Recker ..... B02C 18/145 241/294
2003/0127550 A1 * 7/2003 Stemper ..... B02C 13/2804 241/294

* cited by examiner

ADJUSTABLE FLOW REGULATING ELEMENT RETENTION MECHANISM FOR MATERIAL PROCESSING APPARATUS

TECHNICAL FIELD

The application generally relates to the field of materials processing and more specifically to a pulverizing or other material processing apparatus that includes a plurality of flow regulating members (hereinafter referred to as "velocity regulators") disposed within corresponding pockets formed in at least one rotor of the apparatus, as well as an adjustable mechanism for retaining and releasing velocity regulators within the rotor(s) of the processing apparatus.

BACKGROUND

Various apparatus for the processing of materials, such as pulverizing or other material colliding apparatus are known in which a flowing material such as grain, concrete, wood and the like can be introduced for purposes of reduction. Examples of such apparatus are replete, such as those described in U.S. Pat. No. 7,055,769B2 and U.S. Pat. No. 5,947,396, each apparatus having a pair of rotors that are supported for rotation within a housing or other enclosure. A plurality of hammers or impact blades are retained in a predetermined configuration by the rotors, the impact blades being retained by means of shear pins or similar attachment members. The rotors and the impact blades rotate continuously and cause material entering the housing to be impacted and reduced by features of the retained impact blades. One problem in using an apparatus of this type is that of efficiency. That is, the impact blades and/or attachment mechanism wear down over time, prompting significant down time of the entire material colliding apparatus for purposes of replacement or repair.

There is a general need to develop a reliable and adjustable retention mechanism, such as for hammermills or other material colliding or processing apparatus, which enables easier replacement and repair but without requiring significant down time of the processing apparatus.

SUMMARY

Therefore and according to one aspect, there is provided an adjustable mechanism for releasably securing, maintaining and releasing or ejecting an impact blade or velocity regulator in a material colliding apparatus, the apparatus including at least one rotor which is disposed for rotational movement and has a plurality of circumferentially disposed pockets, each of the pockets being configured for securably retaining a portion of a flow regulating element referred to herein as a velocity regulator. The adjustable mechanism is configured to be positioned within the rotor pocket adjacent the velocity regulator and comprises a first wedge block and a second wedge block. In at least one version, the first wedge block is static while the second wedge block is movable relative to the first wedge block and in which each of the first and second wedge blocks include inclined surfaces that are positioned into frictional engagement with one another. The retaining mechanism further includes a tensioning or actuating member disposed through the first and second wedge blocks. When assembled within a rotor pocket, the first wedge block includes a mounting surface in contact with an edge of the velocity regulator and the second wedge block includes a mounting surface in contact with a side wall of the rotor pocket. The second wedge block is made movable relative to the first wedge block when the actuating member is tightened or loosened to enable retention and/or release of the velocity regulator within the defined rotor pocket.

Summarily, the herein described adjustable retaining mechanism employs a double acting threaded actuator which further employs principles of a simple wedge in order to securely and simply retain velocity regulators in a rotor or rotary member of a material colliding apparatus.

According to another aspect, there is provided a material collider apparatus comprising a pair of rotors disposed in parallel relation within a housing, each of the rotors being disposed for rotation. The apparatus further includes a plurality of flow regulating elements, referred to as velocity regulators, extending radially from the rotors in a spaced relation, the rotors including a plurality of pockets that individually retain a velocity regulator. An adjustable retaining mechanism is disposed within each pocket along with a velocity regulator, the adjustable retaining mechanism comprising a first wedge portion having an upper block flange, and a second wedge portion, each of the first and second wedge portions having inclined surfaces that are engaged with one another, and an actuating member disposed through the first and second wedge portions. The second wedge portion includes a mounting surface in contact with an edge of the velocity regulator and the first wedge portion includes a mounting surface in contact with a side wall of the pocket wherein the second wedge portion is movable relative to said first wedge portion when the actuating member is engaged, thereby permitting tightening and release of the velocity regulator in a defined pocket.

According to one version, a single tensioning member is provided that reliably and repeatably moves the two wedge blocks relative to one another. The herein described mechanism is simple in terms of its overall construction, thereby minimizing the overall number of parts required to securably retain the velocity regulators, as well as the precision required in manufacturing the collider apparatus.

In at least one version, the first and second wedge portions each include a pivot pin through which the actuating member is advanced, the pivot pin being transversely mounted relative to the actuating member and including openings to permit the passage of the actuating member therethrough. Preferably, the actuating member is a threaded fastener.

According to a preferred embodiment, the velocity regulator comprises a shank having a outwardly tapering portion that is disposed within the pocket and in which the outwardly tapering portion compressively engages a wall of one of the wedge portions based on linear advancement of the actuating member.

According to yet another aspect, there is provided a material collider apparatus comprising a housing and at least one rotor disposed within the housing that is supported for rotation. A plurality of flow regulating elements referred to herein as velocity regulators are disposed within corresponding slots or pockets defined in the at least one rotor in a predetermined arrangement to promote pulverization or reduction of material. An adjustable retaining mechanism comprises a pair of opposing wedge blocks and a tensioning member extending through the opposing wedge blocks to enable relative movement of the wedge blocks within a rotor pocket to secure a velocity regulator within the apparatus and to selectively release or eject the velocity regulator therefrom.

According to yet another aspect, there is provided a method for enabling retention and release of a flow regulating member such as a velocity regulator in a material collider apparatus, the method comprising the steps of:

providing a rotor having a plurality of machined pockets; providing a plurality of velocity regulators sized for reception by the plurality of pockets; and providing a corresponding plurality of adjustable retaining mechanisms that are sized for reception with a velocity regulator within a pocket of the rotor. According to at least one version, each retaining mechanism comprises a first wedge portion having an upper block flange, and a second wedge portion, each of the first and second wedge portions having inclined wedge surfaces that are engaged with one another, and an actuating member disposed through first and second wedge portions. The second wedge portion includes a mounting surface in contact with an edge of the velocity regulator and the first wedge portion includes a mounting surface in contact with a side wall of the pocket wherein the second wedge portion is movable relative to said first wedge portion when the actuating member is engaged, thereby permitting tightening and release of the velocity regulator in a defined rotor pocket.

In at least one embodiment, the adjustable retaining mechanism design is intended to provide quick access to the velocity regulators when access to the rotor(s) is limited by the material colliding apparatus to radial access, such as when the rotors are already installed in the apparatus, thereby facilitating replacement and repair time.

Advantageously, centripetal forces that are generated by the at least one spinning rotor tend to generate outward forces against the pockets in the rotor and the adjustable retaining mechanism, which increases the defined wedge action and prevents premature ejection of the flow regulating elements from the material collider apparatus.

Another advantage provided is that of a reliable and adjustable retaining mechanism for a material collider apparatus is herein provided that is simple in terms of its construction and ease of use, but effective in terms of its design and overall functionality.

These and other objects and advantages will be readily apparent from the following Detailed Description, which should be read in conjunction with the accompanying drawings.

DETAILED DESCRIPTION

The following relates to an exemplary embodiment of a material collider apparatus, such as a hammermill, that is used for the processing and reduction of various materials such as concrete, wood and the like. More specifically, this description relates to an adjustable retaining mechanism used with a plurality of individual flow regulating elements herein referred to as "velocity regulators" that are secured within at least one rotor of an exemplary material collider apparatus. It will be readily apparent that a myriad of other suitable materials processing apparatus that employ at least one rotary element and flow regulating elements could be contemplated for use with the herein described retaining mechanism. In addition and throughout the course of discussion, a number of various terms such as "front", "back", "distal", "proximal". "upper", "lower", "upward" and "downward" among others, are frequently used in order to provide a suitable frame of reference in regard to the accompanying drawings. These terms are not intended to limit the scope of the invention, including the attached claims, except where so expressly indicated. Still further, the drawings are provided to more clearly show the salient features of the herein described apparatus, including the adjustable retaining mechanism. To that end, the reader should not rely upon any particular scaling that is employed by the drawings, unless where specifically indicated.

For purposes of background, pulverizing and other material collider apparatus, such as hammermills, are generally constructed with a plurality of individual impact blades that are mounted onto at least one rotor that is supported for rotation, the latter being connected to a motorized drive train including a drive shaft extending through a center axis of the rotor(s). As the rotor turns, the correspondingly rotated impact blades and more specifically a leading edge thereof come into engagement with material flowing therethrough that is to be reduced in size. The impact blades are manufactured from materials that possess a sufficient degree of hardness to deliver a force that deflects and drives the material outwardly along a preferred path through the apparatus and into screens that are provided into and circumscribing at least a portion of the interior surface of an assembly housing. The size of particulate material can therefore be controlled by the size of the apertures of the screen against which the rotating impact blades force the material. Exemplary embodiments of hammermills are disclosed in U.S. Pat. Nos. 5,904,306, 5,842,653, 5,377,919, and 3,627,212.

Figure 1:
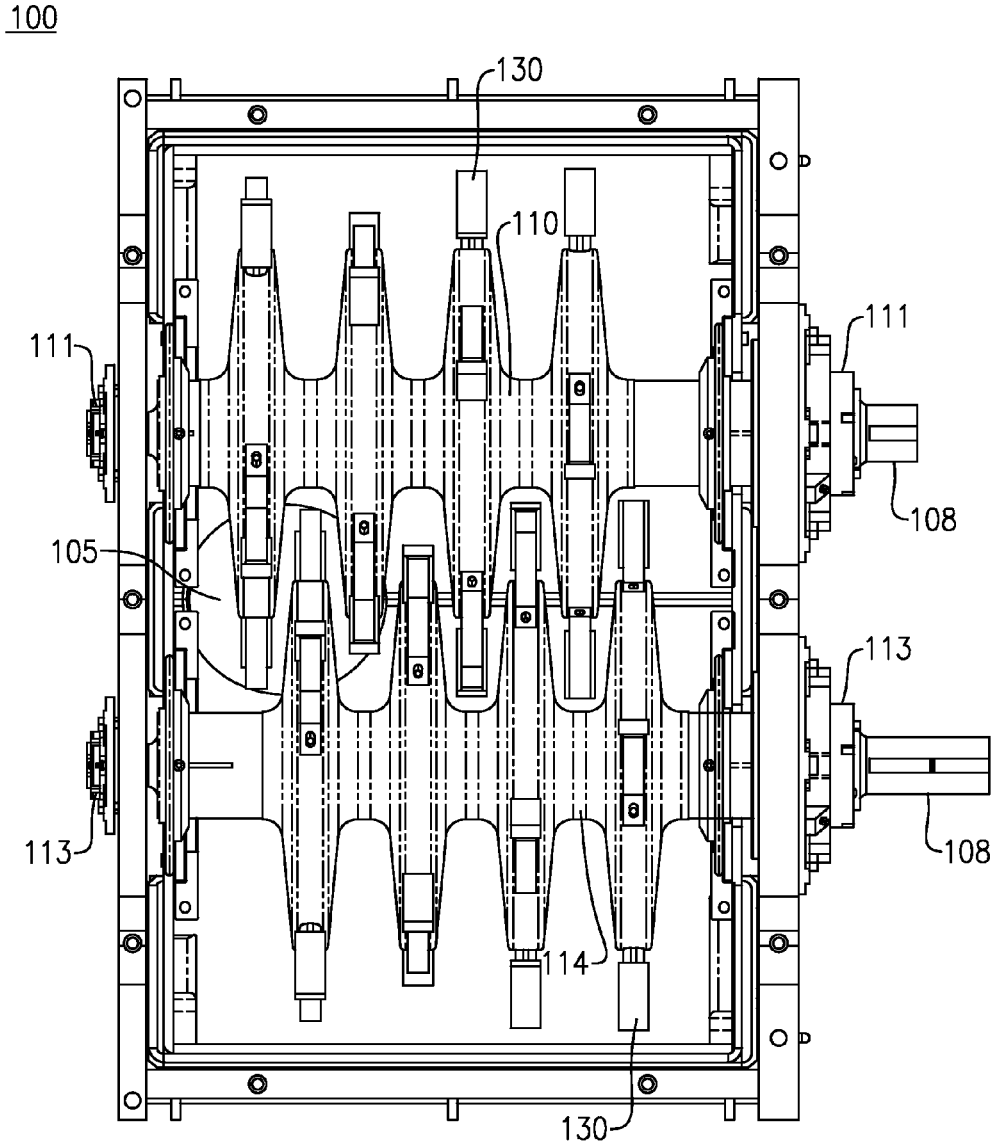
FIG. 1 is a top plan view of a material collider apparatus made in accordance with an exemplary embodiment.
Figure 2:
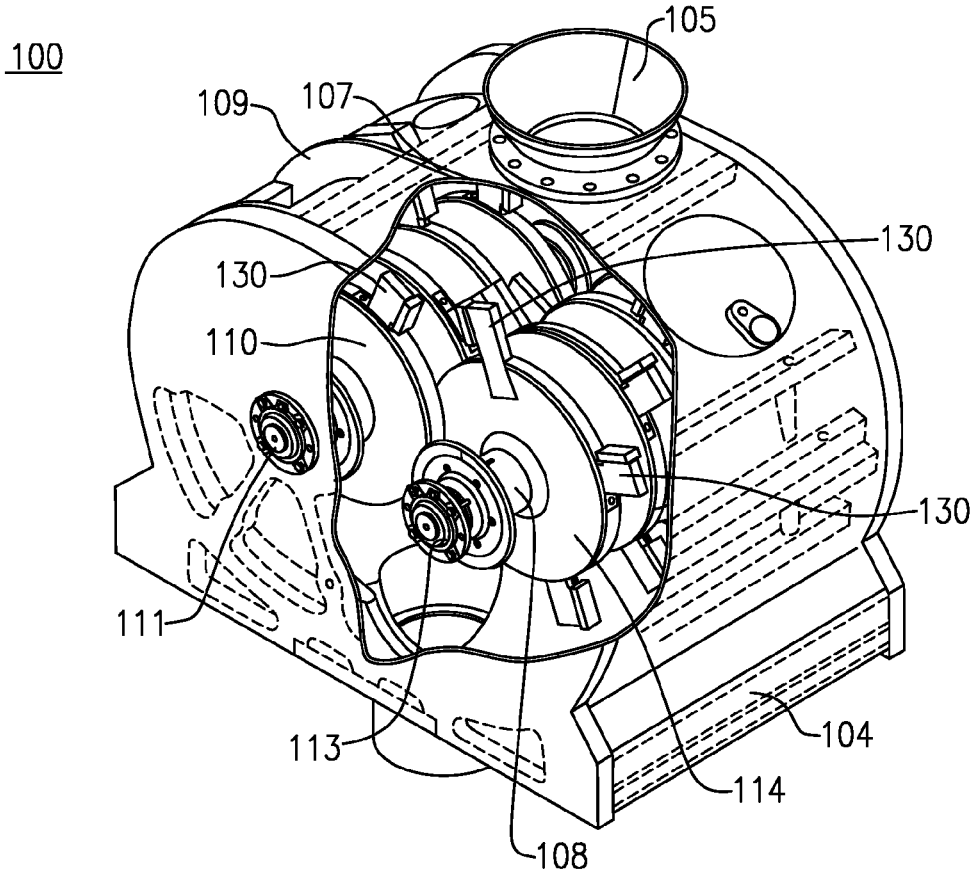
FIG. 2 depicts a top perspective view of the material collider apparatus of FIG. 1, partially broken away.

With reference to FIGS. 1 and 2, there is shown a material collider apparatus 100 in accordance with the exemplary embodiment. A pair of rotors; namely, a first rotor 110 and a second rotor 114 are disposed within the interior of a lower housing frame 104. The rotors 110, 114 are disposed in side by side relation in which each rotor 110, 114 is supported for rotation about a center axis. More specifically, a drive shaft 108 passes through the center of each rotor 110, 114 and through respective bearings 111, 113 that are provided at the walls of the lower housing frame 104. As mounted, the rotors 110, 114, including the drive shafts 108, are parallel to one another. A plurality of flow regulating elements (velocity regulators) 130 are retained by each of the rotors 110, 114, each velocity regulator 130 being retained along with an adjustable retaining mechanism 150 within one of a plurality of specially defined pockets 118 formed in the rotors 110, 114. Flowable material such as wood, stone, grain or the like is added through a port 105 formed in an upper cover liner 107 that is attached to the upper housing frame 109 which attached to a lower housing frame 104. The interior surface of the attached cover liner 107 is made from an abrasion resistant steel. In a preferred version, the screen liner 107 is removable from the interior of the upper housing frame 109 without having to disassemble the lower housing frame 104.

Figure 3:
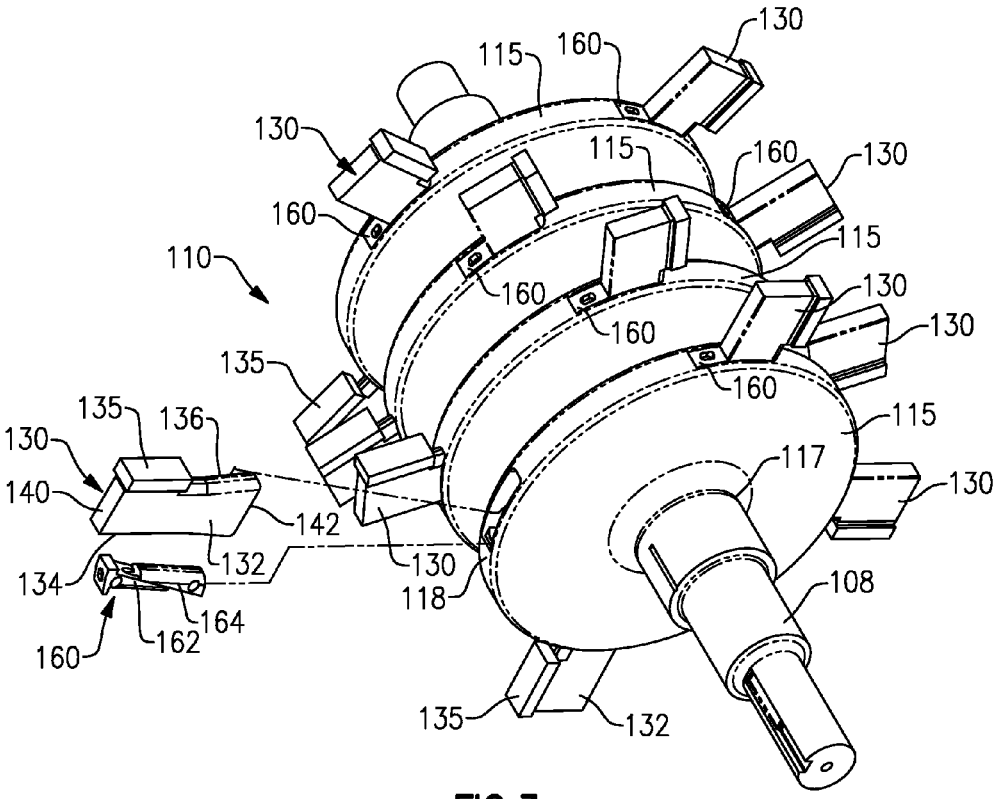
FIG. 3 is a perspective view of a single rotor of the material collider apparatus of FIG. 2, showing a plurality of assembled flow regulating elements including a single velocity regulator and adjustable retaining mechanism separated from the rotor and in accordance with an exemplary embodiment.

Referring to FIG. 3, one of the rotors 110 is herein described in greater detail. It should be noted that each rotor 110, 114 includes the same structural features and therefore a detailed discussion of both components is not required. The rotor 110 is defined by a plurality of rotor plates 115 disposed in series and commonly supported by the drive shaft 108 through aligned center openings 117 which are formed in each rotor plate 115. According to this specific embodiment, four (4) precision machined pockets 118 are disposed within each rotor plate 115 in an equally spaced configuration and wherein each succeeding rotor plate 115 is angularly and progressively clocked relative to an adjacent rotor plate 115 by approximately 22.5 degrees. The pockets 118 are evenly spaced from one another about an outer periphery of each rotor plate 115 such that total of sixteen (16) spaced rotor pockets 118 are provided per rotor 110 according to this embodiment and thirty two (32) velocity regulators total are mounted between the adjacent rotors 110, 114. It will be readily apparent that the number of rotor plates 115 and pockets 118, as well as the angular displacement between rotor pockets 118 can be suitably varied. In at least one version, and through an external drive mechanism (not shown) the two rotors 110, 114, may or may not be rotationally timed so as to coordinate the interface between the counter rotating velocity regulators 130.

In addition, an adjustable retaining mechanism 150 is disposed for placement in each pocket 118 along with a flow regulating element (i.e., a velocity regulator 130). As described herein, the adjustable retaining mechanism 150 is provided for securing, retaining and permitting replacement of velocity regulators 130 used in connection with the herein described material collider apparatus 100.

Details relating to each of the velocity regulators 130 and the adjustable retaining mechanism 150 are herein described in accordance with this exemplary embodiment: First and still referring to FIG. 3, each velocity regulator 130 is defined by a body or shank 132 made from a low carbon steel and having attached thereto an abrasive resistant tile 135. The shank 132 is a rectilinear member that is further defined according to this exemplary embodiment by a shank trailing edge 134, a shank leading edge 136 and a pair of base edges 140, 142 at the upper and lower ends of the shank 132, respectively. The abrasive resistant tile 135 is secured to an upper portion of the shank leading edge 136 of the velocity regulator 130. The abrasive resistant tile 135 can, for example, be made from tungsten carbide or other durable and hard material. The upper base edge 140 and the abrasive resistant tile 135 are substantially coplanar, with an upper portion of the tile 135 extending slightly over the upper base edge 140. According to this embodiment, the exposed lower portion of the shank leading edge 136 is contoured. The shank trailing edge 134 of the velocity regulator 130 is also shaped wherein the overall width dimension of the shank 132 tapers from a maximum at the lower base edge 142 and each of the trailing edge 134 and leading edge 136 of the shank 132 taper uniformly and inwardly. The resulting effect is that the shank 132 of the velocity regulator 130 is fabricated with two complimentary opposing angles and a contoured leading edge 136 which, when assembled in the material collider apparatus 100, compliment the herein described adjustable retaining mechanism 150 and the defined machined pocket 118 of the rotor 110.

Figure 4:
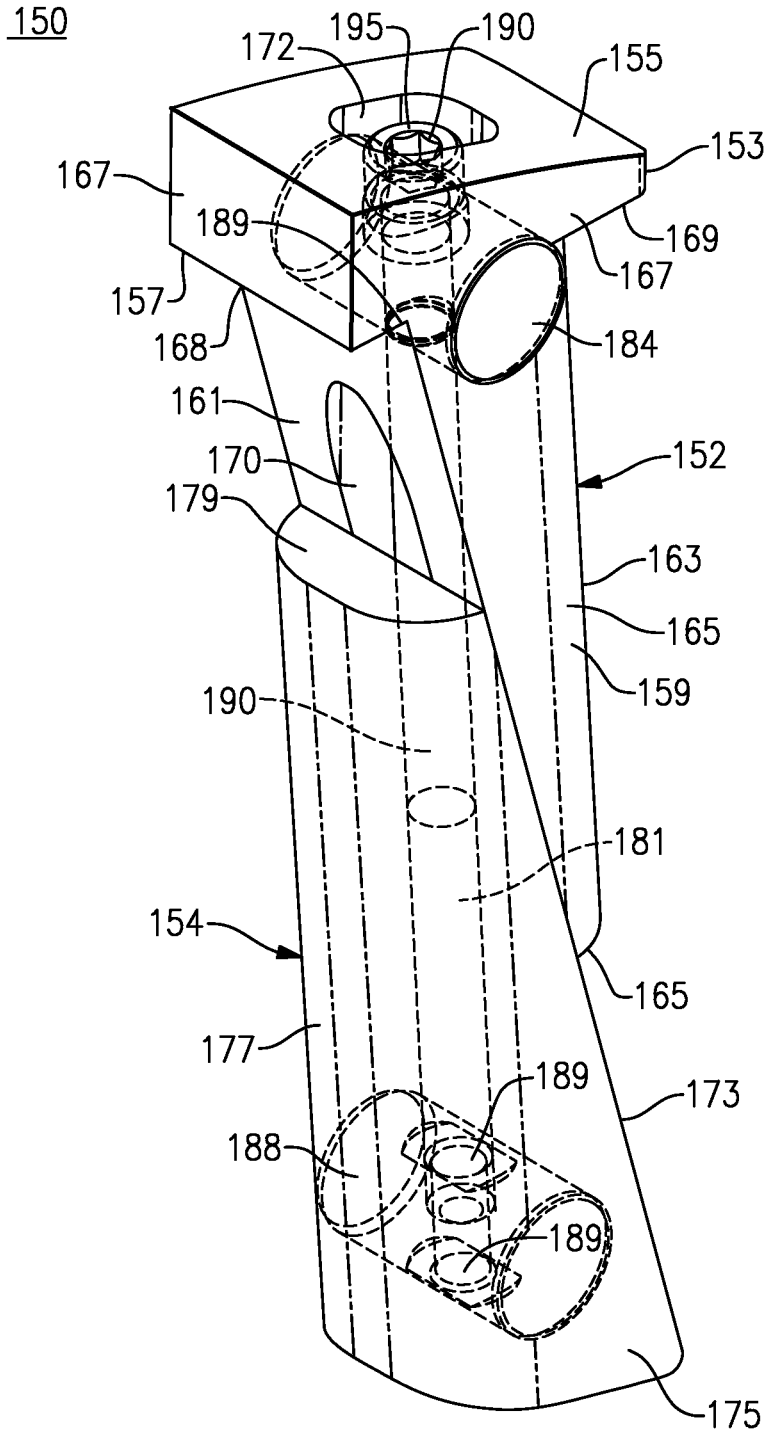
FIG. 4 is an enlarged perspective view, partially sectioned, of the adjustable retaining mechanism of FIG. 3.

Referring to FIG. 4, the adjustable retaining mechanism 150 according to this exemplary embodiment is defined by a pair of complementary wedge blocks, and more specifically a first wedge block 152 and a second wedge block 154. The first wedge block 152 is defined by an upper portion 153 including a top surface 155 and an opposing bottom surface 157, as well as a wedge-shaped lower portion 159 that extends downwardly from an intermediate portion of the bottom surface 157. The wedge-shaped lower portion 159 is defined, according to this embodiment, by an inclined surface 161, a opposing planar surface 163 and a pair of lateral surfaces 165 in which the overall thickness of the wedge-shaped lower portion 159 (i.e., the distance between the inclined surface 161 and the opposing planar surface 163) is at a maximum at the bottom surface 157 of the upper portion 153 and decreases in a tapering fashion due to the inclined surface 161 to a minimum thickness at a flat lower surface 165 of the first wedge block 152.

The upper portion 153 of the first wedge block 152 is a rectilinear section defined by the top surface 155, the bottom surface 157 and four lateral surfaces 167 defining an anvil-like shape. More specifically and according to this embodiment, the thickness (i.e., the distance between the top surface 155 and the bottom surface 157 of the upper portion 153) is at a minimum on a trailing side 167 and gradually increases to a maximum on a leading side 153 thereof. The bottom surface 157 of the upper portion 153 further includes trailing and leading flanges 168, 169 proximate the wedge-shaped lower portion 159. An elongated slot 170 extends over a majority of the inclined surface 161 of the first wedge block 152 and further extends to a center opening 172 which is provided in the top surface 155 of the upper portion 153.

The second wedge block 154 is somewhat similar in terms of its construction to that of the wedge-shaped lower portion 159 of the first wedge block 152. An inclined surface 173 is formed between a base section 175 of the second wedge block 154 and a flat upper surface 179. The remainder of the wedge block 154 is substantially formed as a curvi-linear contoured section 177. The thickness of the wedge block 154 according to this embodiment is at a maximum at the base section 175 and decreases due to the taper in the inclined surface 173 to a minimum at the upper flat surface 179 thereof. An elongated slot 181 (shown in phantom) is also formed in the inclined surface 173 of the second wedge block 154, similarly extending over the majority thereof and extending through an opening formed in the base section 175. According to the exemplary embodiment, each of the inclined surfaces 161, 173 are angled approximately 5 degrees, although this parameter can be suitably varied.

The first and second wedge blocks 152, 154 are arranged according to the herein described mechanism 150 such that the inclined surface 161 of the first wedge block 162 is in direct frictional engagement with the inclined surface 173 of the second wedge block 154 and the elongated slots 170, 181 are aligned with one another. Each of the first and second wedge blocks 152, 154 further include a pivot pin disposed therein. More specifically and according to this exemplary embodiment, a first pivot pin 184 is disposed beneath the upper section 153 of the first wedge block 152 and a second pivot pin 188 is disposed adjacent the base section 175 of the second wedge block 154. The pivot pins 184, 188 are securably attached in each wedge block 152, 154 and arranged such that the primary axis of each pin is transverse to the major dimensions of the first and second wedge blocks 152, 154. Each of the pivot pins 184, 188 include respective through openings 189 aligned with the elongated slots 170, 181 that are sized to permit the passage of a tensioning or actuating member 190. The tensioning member 190 according to this exemplary embodiment is defined by a threaded shank 194 sized to fit through each of the aligned slots 170, 181 of the engaged wedge blocks 152, 154, as well as the transverse openings 189 provided in each of the pivot pins 184, 188. The tensioning member 190 is further defined by a countersunk head 195 that is accessible through the center opening 172 provided in the upper portion 153 of the first wedge block 152 and snap ring groove enabling quick extraction of the outer most wedge block 152.

Referring to FIGS. 5-8, the securement of a single velocity regulator 130 is herein described relative to a rotor 110 and more specifically in relation to an exemplary pocket 118 of one of the rotor plates 115, FIG. 3. The pocket 118 is precision-machined into the rotor plate 115 and defined by a circumferential slot that includes respective side wall and bottom bearing surfaces 120, 122 sized and configured for receiving the lower portion of the shank 132 and more specifically the leading edge 136 and the bottom base edge 142, respectively, thereof. The rotor pocket 118 further includes respective side and bottom bearing surfaces 124, 126 and an opening that is sized and configured for receiving the adjustable retaining mechanism 150.

According to this embodiment, the portion of the rotor pocket 118 that retains the adjustable retaining mechanism 150 has a larger (deeper) depth dimension than the portion of the pocket 118 that is configured for retaining the velocity regulator 130. An intermediate step or wall 127 separates the bottom bearing surfaces 122 and 126. In addition, the side walls 120 at the leading edge of the pocket 118 are contoured and rounded to be complementary to the leading edge 136 of the velocity regulator shank 132 and the side wall 124 of the defined pocket 118 includes an upper ledge 129.

Figure 5:
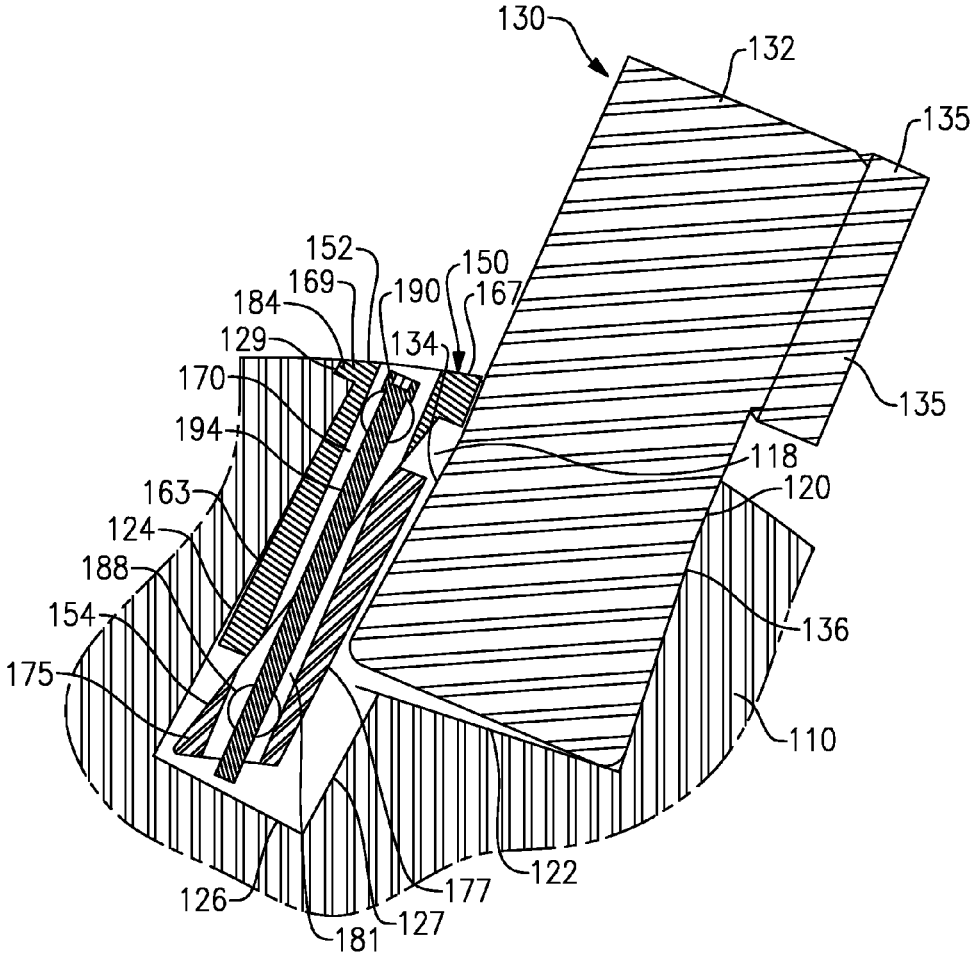
FIG. 5 is a sectioned partial view of a receiving pocket of a rotor, including a velocity regulator and an adjustable retaining mechanism in a loosened condition.

In terms of assembly and as shown in FIG. 5, the velocity regulator 130 and more specifically the leading edge 136 of the lower part of the shank 132 engages the contoured side walls 120 of the pocket 118 and the bottom surface 122 receives the bottom base edge 142. When assembled, the abrasive resistant tile 135 of the shank 132 is disposed above the defined pocket 118, as shown. The adjustable retaining mechanism 150 is then positioned within the pocket 118 and disposed between the trailing edge 134 of the velocity regulator 130 and the trailing side wall 124 of the precision-machined rotor pocket 118 wherein the upper ledge 129 is sized and configured to support the trailing end flange 169 of the upper portion 153 of the first wedge block 152 and with the leading edge flange 167 adjacent the trailing edge 134 of the velocity regulator 130 initially above the contoured and tapering lower portion thereof. When assembled, the upper portion of the planar surface 163 of the first wedge block 152 engages the side wall 124 of the pocket 118 while the contoured surface 177 of the second wedge block 154 is proximate, but not in contact with the trailing edge 134 of the velocity regulator shank 132. The adjustable retaining mechanism 160 is shown in an initial loosened condition in FIG. 5. In this position, the shank 194 of the tensioning member 190 extends through the opening defined in the base section 175 of the second wedge block 154.

Figure 6:
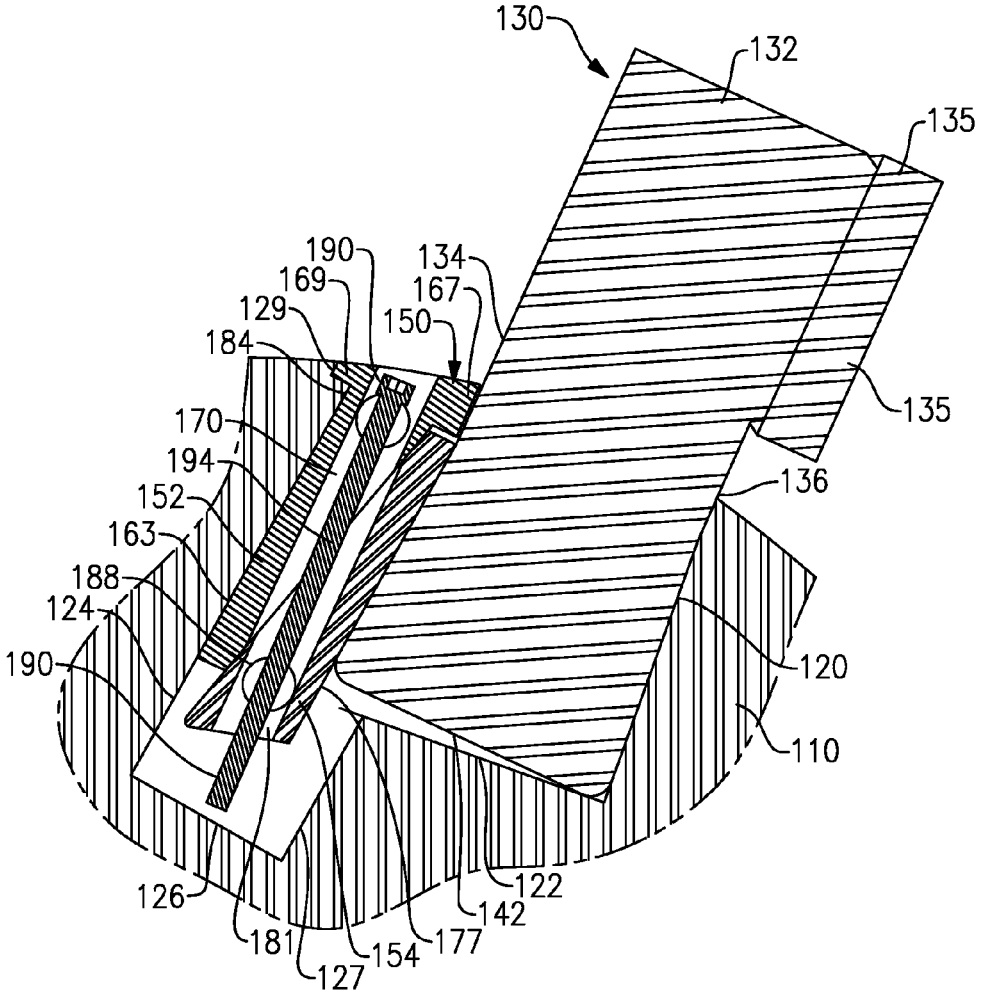
FIG. 6 is the sectioned partial view of the rotor receiving pocket of FIG. 5, illustrating the velocity regulator and the adjustable retaining mechanism in a clamped condition.
Figure 7:
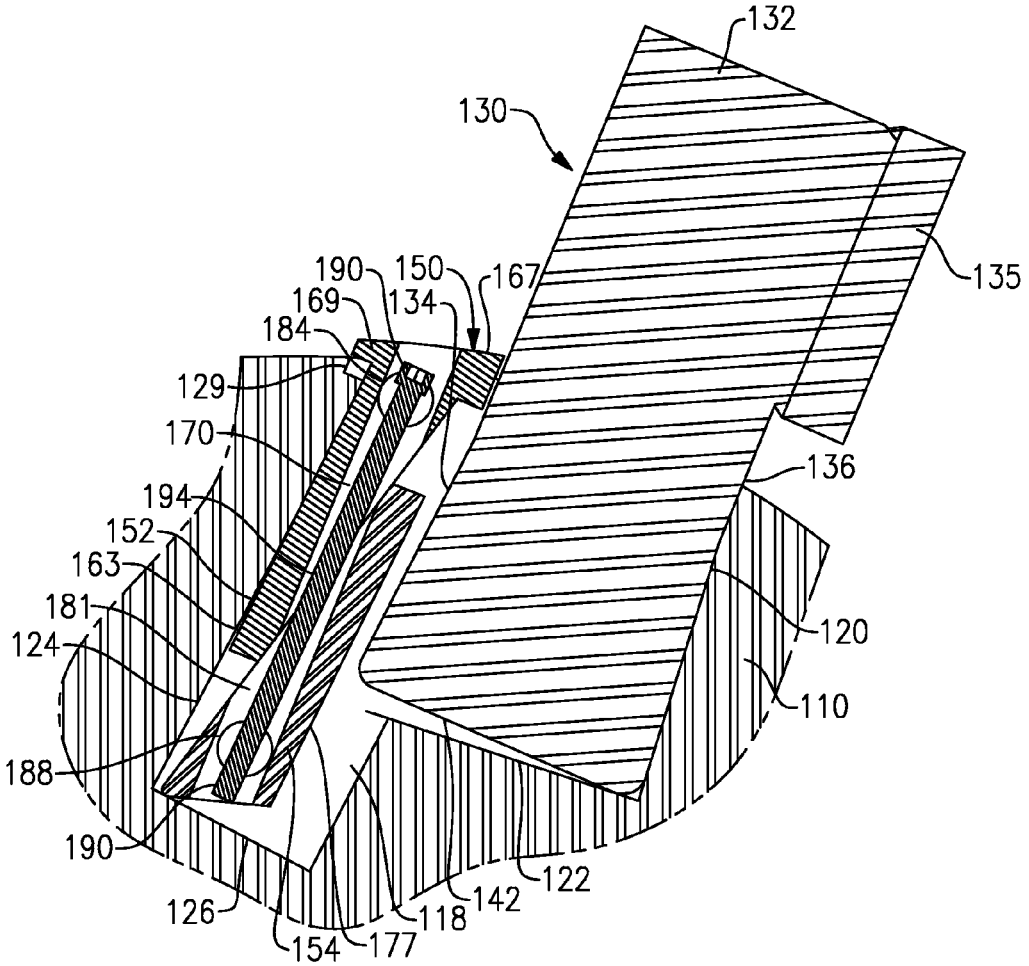
FIG. 7 is the sectioned partial view of the rotor receiving pocket of FIGS. 5 and 6, illustrating a velocity regulator and adjustable retaining mechanism in an ejected position.

In operation and by turning the tensioning member 190 in a first predetermined direction (i.e., clockwise), FIG. 6, the first wedge block 162 is statically maintained due to the contact between the trailing end flange 169 with the upper ledge 129 of the pocket 118 while the second wedge block 154 is moved within the pocket 118 relative to the first wedge block 152 and more specifically is drawn closer (upwardly) relative to the supported upper portion 153 of the first wedge block 152, as shown. More specifically, the inclined surface 181 of the second movable wedge block 154 "rides" the corresponding inclined surface 170 of the first wedge block 152, the contoured surface 177 of the second wedge block 154 engages the tapered trailing edge 134 of the velocity regulator 130, creating a clamping action thereon. The tensioning member 190 is turned until the tensioning member 190 has been torqued to a specific threshold (e.g., 30 inch pounds), securing the velocity regulator 130 in place within the rotor pocket 118 due to relative expansion of the adjustable retaining mechanism 150.

Figure 8:
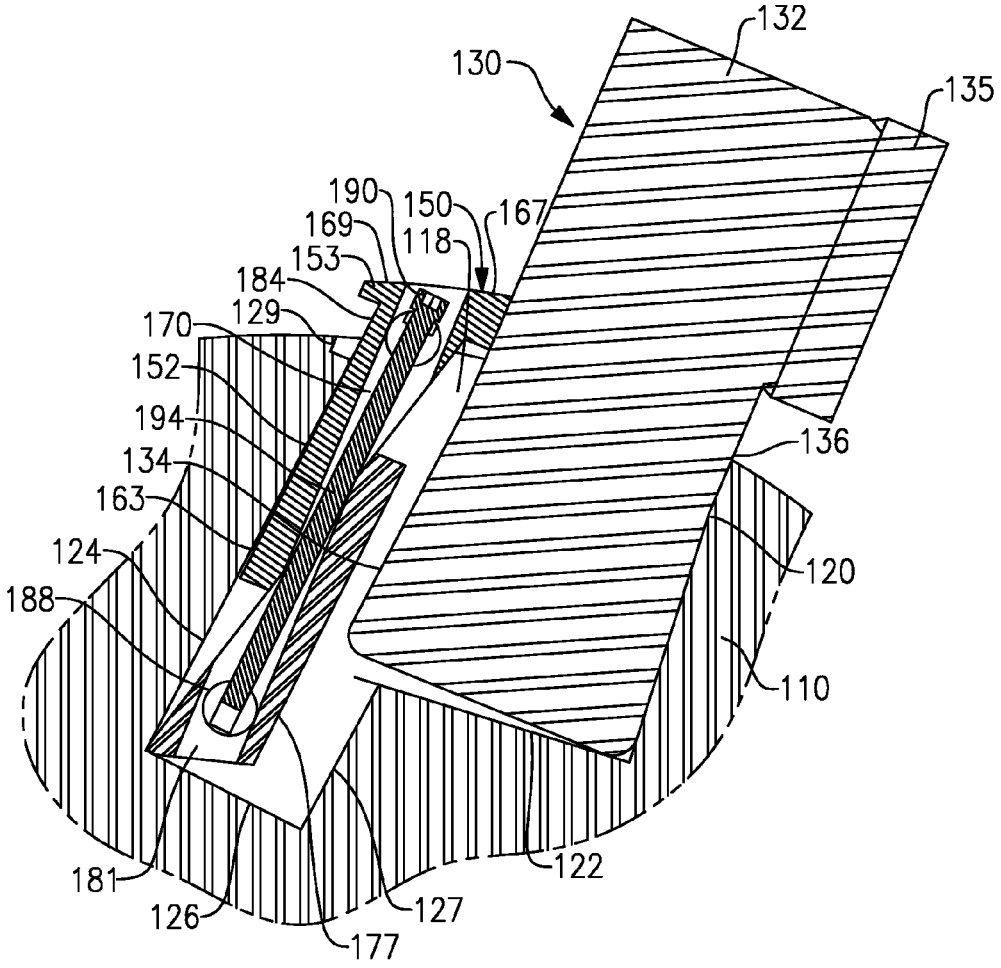
FIG. 8 is the sectioned partial view of the rotor receiving pocket of FIGS. 5-7, illustrating the velocity regulator and adjustable retaining mechanism in a fully ejected position.

Referring to FIGS. 6, 8 and 9, a velocity regulator 130 can be released from the defined pocket according to this exemplary embodiment by turning the tensioning member 190 in the opposite direction (i.e., counterclockwise) by accessing the countersunk head 195 through the center opening 172 of the top surface 155 of the first wedge block 152. Once the tensioning member 190 has been sufficiently loosened, the second wedge block 154 and more specifically the contoured surface 177 is caused to move away from the trailing edge 132 of the velocity regulator 130 as the second wedge block 154 is caused to move downwardly within the defined pocket 118 toward the bottom bearing surface 126 and in which the distance between the surfaces 163, 167 of the retaining mechanism 150 are reduced in width. According to this exemplary embodiment, further turning of the tensioning member 190 in the loosening (i.e., counter clockwise) direction will create further relative movement between the inclined surfaces 170, 181 of the contacting first and second wedge blocks 152, 164. However, because the distance between the side wall of the rotor pocket 118 and the velocity regulator 130 is constant, the application of additional force against the tensioning member 190 will cause ejection of the first wedge block 152 for easier removal of the velocity regulator 130 from the rotor pocket 118 for replacement or other purposes.

As a result of this action upon the tensioning member 190, the first wedge block 152 and more specifically the upper portion 153 is released from the upper ledge 129 of the pocket 118 permitting the velocity regulator 130 to be released from the pocket 118 of the rotor 110 as further shown in FIGS. 8 and 9, that permit ejection of the retaining mechanism 150 from the pocket 118, as well as the velocity regulator 130.

In terms of overall operation and referring to FIGS. 1 and 2, each of the parallel rotors 110, 114 are caused to turn at a predetermined speed that enables collision of entering particles to take place. Material (not shown), such as rock, is introduced through the housing inlet or port 105 in a fluidized state for purposes of reduction. As this material interacts with the rotors 110, 114 and the supported velocity regulators 130, this material is driven radially outward against the inside surface of the housing. Each rotor 110, 114 counter rotates in such a way that the fluidized material is directed by the velocity regulators 130 to flow radially around the inside of the housing, such that the material collides at the top of the housing. When the rotors 110, 114 are driven at the correct operating speed, the action of this material colliding with itself causes the particles to disintegrate. As the fluidized bed of material flows axially through the housing under the guidance of the staggered velocity regulators 130, each progressive collision of the fluidized material continues to decrease the aggregate particle size.

Eventually, this axial flow of the fluidized material reaches a discharge port of the housing and is released. Using this method it is possible to quickly transform material, such as rocks that are golf-ball sized into a finely reduced flour.

PARTS LIST FOR FIGS. 1-8

100 hammermill
104 lower housing frame
105 port
107 upper cover liner
108 drive shaft
109 upper housing frame
110 first rotor
111 bearing
112 second rotor
113 bearing
115 rotor plates
117 center openings
118 slots or pockets
120 side walls, pocket end
122 bottom surface
124 side walls, pocket end
126 bottom surface
127 intermediate wall or step
129 upper ledge
130 velocity regulator
132 body or shank
134 shank trailing edge
135 abrasive resistant tile
136 shank leading edge
140 upper base edge
142 bottom base edge
150 retaining mechanism
152 first wedge block
153 upper portion
154 second wedge block
155 top surface
157 bottom surface
159 wedge-shaped lower portion
161 inclined surface
163 planar surface
165 flat lower surface
167 lateral surfaces
168 flange, trailing edge
169 flange, leading edge
170 elongated slot
172 center opening
173 inclined surface
175 base portion
177 contoured section
179 flat surface, upper
181 elongated slot
184 first pivot pin
188 second pivot pin
189 through openings
190 tensioning member
194 shank, threaded
195 head, countersunk
200 snap ring It will be readily apparent that there are a number of variations and modifications that will be apparent to one of sufficient skill employing the herein described concepts and in accordance with the following claims.

The invention claimed is:

1. In combination, an adjustable mechanism for retaining and releasing a flow velocity regulator in a material collider apparatus, the material collider apparatus comprising:

at least one rotor disposed for rotational movement and having a plurality of circumferentially disposed pockets, each of the pockets retaining a portion of a flow velocity regulator and the adjustable mechanism, the adjustable mechanism comprising:

a first wedge portion having an upper block flange, a second wedge portion, each of the first and second wedge portions having inclined surfaces that are engaged with one another and an axial through opening including an elongated slot disposed along the inclined surface, each of the axial through openings of the first and second wedge portions being aligned with one another, and a tensioning member disposed through the aligned openings of the first and second wedge portions, in which the second wedge portion includes a mounting surface opposite the inclined surface in contact with an edge of the flow velocity regulator, a lateral surface of the upper block flange of the first wedge portion also in contact with the edge of the flow velocity regulator, and wherein an opposite portion of the upper block flange is fitted within a recess at the top of the pocket against a formed shoulder wherein the second wedge portion is movable relative to said first wedge portion when the tensioning member is tightened or loosened within the aligned openings, thereby permitting tightening and release of the flow velocity regulator and wherein the first wedge portion is prevented from movement when the tensioning member is advanced in the tightening direction.

2. The adjustable mechanism of claim 1, in which the first and second wedge portions each include a pivot pin through which the tensioning member is advanced, the pivot pin being transversely mounted relative to the tensioning member and including openings to permit the passage of the tensioning member therethrough.

3. The adjustable mechanism of claim 1, wherein the tensioning member is a threaded fastener.

4. The adjustable mechanism of claim 1, in which the flow velocity regulator comprises a shank having a outwardly tapering portion that is disposed within the pocket and in which the outwardly tapering portion compressively engages a wall of one of the wedge portions based on linear advancement of the tensioning member.

5. A material collider apparatus comprising:

a pair of rotors disposed in parallel relation within a housing, each of the rotors being disposed for rotation;

a plurality of flow regulating elements referred to as velocity regulators extending radially from the rotors in a spaced relation, the rotors including a plurality of pockets that individually retain an impact plate; and an adjustable retaining mechanism disposed within each pocket adjacent to a velocity regulator, the adjustable retaining mechanism comprising:

a first wedge portion having an upper block flange, and a second wedge portion, each of the first and second wedge portions having inclined surfaces that are engaged with one another and a through axial opening, a portion of the opening being defined by an elongated slot defined along the inclined surface, the through axial openings of the first and second wedge members being aligned with one another, and a tensioning member disposed through first and second wedge portions, in which the second wedge portion includes a mounting surface in contact with an edge of the velocity regulator and the upper block flange of the first wedge portion includes a lateral surface in contact with the edge of the velocity regulator, the upper block flange further including a portion opposite the lateral surface relative to the opening that is retained within a recess at the top of the pocket and against a shoulder wherein the second wedge portion is movable relative to said first wedge portion when the tensioning member is engaged, thereby permitting tightening and release of the velocity regulator in a defined pocket and in which the first wedge portion is prevented from movement when the tensioning member is advanced in the tightening direction.

6. The apparatus of claim 5, in which the first and second wedge portions each include a pivot pin through which the tensioning member is advanced, the pivot pin being transversely mounted relative to the tensioning member and including openings to permit the passage of the tensioning member therethrough.

7. The apparatus of claim 5, wherein the tensioning member is a threaded fastener.

8. The apparatus of claim 5, in which each velocity regulator comprises a shank having a outwardly tapering portion that is disposed within the pocket and in which the outwardly tapering portion compressively engages a wall of one of the wedge portions based on movement of the tensioning member.

9. A material colliding apparatus comprising:

a housing;

at least one rotor disposed within the housing, the at least one rotor having a plurality of rotor blades;

a plurality of flow velocity regulators individually disposed within machined pockets formed in the at least one rotor in a predetermined arrangement to promote reduction of material; and a corresponding plurality of retaining mechanisms for retaining the flow velocity regulators within the machined pockets, each retaining mechanism comprising a pair of opposing wedge blocks and a tensioning member disposed through the opposing wedge blocks, the pair of wedge blocks comprising a first wedge block and a second wedge block wherein each of the wedge blocks include an inclined surface engaged in contact and a through axial opening that accommodates the tensioning member including an elongated slot disposed along the inclined surfaces and wherein the second wedge block includes a lateral surface in contact with an edge of the flow velocity regulator and the first wedge block includes an upper flange having a lateral surface in contact with the edge of the flow velocity regulator wherein an opposite portion of the upper flange is disposed within a recess at the top of the pocket and against a formed shoulder, thereby preventing movement of the first wedge portion when the tensioning member is advanced in a tightening direction.

10. The apparatus of claim 9, in which each retaining mechanism is adjustable to control movement of one of the wedge blocks relative to the other wedge block through corresponding movement of the tensioning member.

11. A method for enabling retention and release of a flow velocity regulator in a material collider apparatus, the method comprising:

providing a rotor having a plurality of machined pockets;

providing a plurality of flow velocity regulators sized for reception by the plurality of pockets;

providing a corresponding plurality of adjustable retaining mechanisms that are sized for reception with a said flow velocity regulator within a said pocket of the rotor, each retaining mechanism comprising:

a first wedge portion having an upper block flange, and a second wedge portion, each of the first and second wedge portions having inclined surfaces that are engaged with one another and a through axial opening, wherein the through axial opening of each wedge portion is aligned with one another, including an elongated slot disposed along the inclined surfaces of each wedge portion, and a tensioning member disposed through the through opening of the first and second wedge portions, in which the second wedge portion and the upper block flange of the first wedge portion each include a mounting surface in contact with an edge of the flow velocity regulator and the upper block flange further includes a portion retained against a recessed shoulder at the top of the pocket wherein the second wedge portion is movable relative to said first wedge portion when the tensioning member is tightened and loosened, thereby permitting tightening and release of the flow velocity regulator in a defined pocket and wherein the first wedge portion is prevented from movement when the tensioning member is tightened.

12. The method of claim 11, in which relative movement of the first and second wedge portions based on engagement of the tensioning member causes a change in the relative width of the adjustable mechanism in order to effect compressive force onto the velocity regulator.

13. The method of claim 11, wherein the pocket includes a tapered side wall for engaging a tapered edge of the flow velocity regulator opposite the edge engaged by the first and second wedge portions.

14. The apparatus of claim 9, wherein the pocket includes a tapered side wall for engaging a tapered edge of the flow velocity regulator opposite the edge engaged by the first and second wedge portions.

15. The apparatus of claim 9, wherein the pocket is defined by a first recessed portion that retains the flow velocity regulator and a second adjacent recessed portion that retains the retaining mechanism and in which a bottom surface of the first recessed portion is defined by a taper.

16. The method of claim 11, wherein the pocket is defined by a first recessed portion that retains the flow velocity regulator and a second adjacent recessed portion that retains the retaining mechanism and in which a bottom surface of the first recessed portion is defined by a taper.

17. The apparatus of claim 5, wherein the pocket is defined by a first recessed portion that retains the flow velocity regulator and a second adjacent recessed portion that retains the retaining mechanism and in which a bottom surface of the first recessed portion is defined by a taper.

* * * * *